United States Patent [19]

Burger

[11] 4,393,772

[45] Jul. 19, 1983

[54] ROTARY PRINTING MACHINE, PARTICULARLY NEWSPAPER-TYPE OFFSET PRINTING MACHINE

[75] Inventor: Rainer Burger, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 301,319

[22] Filed: Sep. 11, 1981

[30] Foreign Application Priority Data

Sep. 13, 1980 [DE] Fed. Rep. of Germany ..... 3034670

[51] Int. Cl.[3] ..... B41F 7/02

[52] U.S. Cl. ..... 101/217; 101/225; 101/228

[58] Field of Search ..... 101/225, 217–219, 101/228, 153, 156, 178–181, 138, 220–221; 226/189, 91

[56] References Cited

U.S. PATENT DOCUMENTS

| | | | |
|---|---|---|---|
| 1,959,371 | 5/1934 | Lamatsch et al. | 101/220 X |
| 3,288,060 | 11/1966 | Miller | 101/153 |
| 4,325,301 | 4/1982 | Grosshauser | 101/228 |

FOREIGN PATENT DOCUMENTS

| | | | |
|---|---|---|---|
| 2741596 | 3/1978 | Fed. Rep. of Germany | 101/228 |
| 2652977 | 5/1978 | Fed. Rep. of Germany | 101/153 |

*Primary Examiner*—E. H. Eickholt

*Attorney, Agent, or Firm*—Frishauf, Holtz, Goodman & Woodward

[57] ABSTRACT

To permit, selectively, ready access by an operator to printing systems of a multiple system printing machine in which the printing systems are located above and below a laterally introduced web of paper into the machine, the paper path is arranged to be guided, selectively, with a horizontal portion either following a vertical portion, to permit an operator to stand beneath the paper web for access to the lower printing systems (FIG. 1) or, selectively, to position the vertical portion adjacent the printing machine to permit an operator to stand on a movable platform (11) and have access to the printing system above the paper web (FIG. 2), a paper guide roller (6) is vertically movable between an upper position (6, 13, 14) and a lower position (6', 13', 14'). Paper web tension can be maintained by an additional deflection guide roller (8) which is tilted, together with the platform (11) to an engagement position (FIG. 2: 8'), or the paper may hang through (FIG. 3).

13 Claims, 3 Drawing Figures

ROTARY PRINTING MACHINE, PARTICULARLY NEWSPAPER-TYPE OFFSET PRINTING MACHINE

The present invention relates to the printing system of a rotary printing machine, and more particularly to a newspaper-type rotary offset printing machine, in which a web of paper is guided in an essentially vertical path from beneath a supply station towards the printing station, to be introduced therein in an essentially horizontal path, and which permits ready access by opertors to the respective printing systems of the printing station of the machine.

BACKGROUND

Rotary offset printing machines having printing stations in which paper is guided in an essentially vertical path from beneath the machine and then in an essentially horizontal path into the printing station, leaving space beneath the horizontal path for access to the printing systems located beneath this horizontal portion of the path (see, for example: "Techniken, Systeme, Maschinen", page 9, FIG. 17*b*, by Oscar Frei; published by Polygraph-Verlag) are known. Guiding the paper web in the aforementioned path provides for relatively good accessibility to the lower cylinders of the printing system. Difficulties arise, however, particularly when used for newspaper printing, to change plates of the cylinders loated above the horizontal portion of the paper web path, since access to those cylinders is impeded by the paper web itself. Of course, it is possible to relocate the paper path by placing the vertical portion close to the printing stations, so that free access to the upper cylinders can then be provided; yet, if that is done, access to the cylinders of the lower printing system, that is, the one beneath the remaining horizontal portion of the paper path, is then impeded, since the vertical portion close to the lower printing system will then be covered by the paper web.

THE INVENTION

It is an object to so construct the printing machine that access to both the upper as well as lower printing systems of a rotary printing machine can be obtained, without cutting the paper web.

Briefly, a paper guide roller is provided which, selectively, guides the paper in a horizontally extending path to a zone between an upper and a lower printing system, the horizontal path being sufficiently long to permit an operator to stand therebeneath, providing access to the lower printing system; in accordance with the invention, the guide roller means can be selectively shifted in position so that the horizontal portion of the paper path which is sufficiently long to provide access to an operator, comes to fall beneath the paper introduction zone, with a short additional vertical portion, so that, selectively, then access to the upper printing system is provided. A selectively movable platform is additionally provided to permit an operator to stand thereon when the guide roller is deflected to the lower position, to provide a secure support for the operator. The platform can be constructed with holders for a guide or deflection roller, so that, upon changing the path of the paper web from horizontal introduction into the printing zone to, first, a horizontal access portion, then a vertical portion, and further deflection into the printing zone, will be obtained by coupled movement of the platform and of the deflected guide roller.

To obtain the paper web path portions, it is only necessary to retain a guide roller in a suitble movable bearing, at its axial ends, for example in a slider holder, so that the guide roller can be dropped; the paper web path is then so changed that the vertical portion will be immediately adjacent the printing systems, permitting the platform to be moved to the position over the horizontal portion of the paper web, and thus providing ready access for an operator to the printing system above the paper web introduction zone, for example to maintain, clean, or otherwise work on the printing, inking, and damping or fountain systems thereof.

The paper web, in the position permitting access to the upper printing station, may either hang freely or can be stretched by an additional guide roller, after a main guide roller has been dropped, so that printing can be effected even if the paper path has been changed by selective repositioning of the main guide roller.

For purposes of the present specification, the direction of moement of the paper web in the path is immaterial, in other words, whether the path is associated with a portion of the paper web being introduced into the printing stations or into the zone of the printing stations, or removed from the printing stations after printing has been effected, is immaterial, and terminology used specifically in relationship to one direction of movement is not to be understood in a limiting sense but only exemplary, and the opposite direction of movement of the paper web is equally applicable, no further reference to the opposite direction being made being deemed necessary in order to simplify the specification. made being deemed necessary in order to simplify the specification.

DRAWINGS

Figure 1:
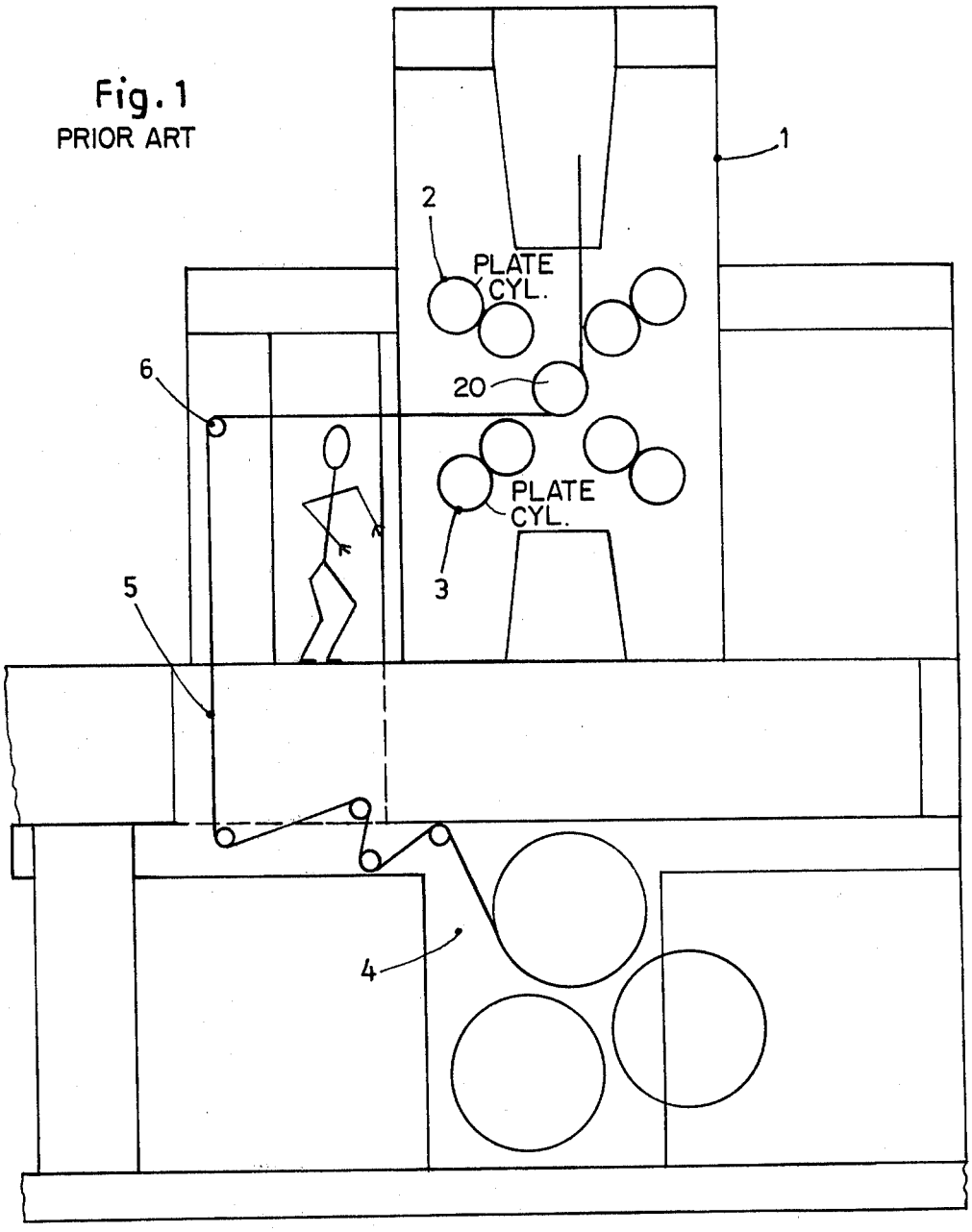
Fig. 1 PRIOR ART
FIG. 1 is a highly schematic side view of a rotary offset printing machine in accordance with the prior art, and illustrating a typical paper guide path, and access to printing systems beneath the horizontal portion thereof.

The general arrangement of the paper web path through a printing machine is best illustrated by reference to FIG. 1, showing a conventional arrangement, in which all parts not necessary for an understanding of the present invention have been omitted, and those which are shown are illustrated highly schematically only.

The printing machine 1 has a frame arrangement, as well known; only the plate cylinders 2 and 3 and the impression cylinder 20 of the printing station 1 of the machine are separately identified: they cooperate in customary manner with a blanket cylinder, transfer and deflection cylinders, inking and damping fountain systems and the like—all not shown and entirely conventional. The printing station is generally H-shaped, and is positioned above a spider holder 4 from which a paper web 5 is withdrawn, guided over suitable guide, deflection and tensioning rollers, and over a guide roller 6. The path of the paper web 5 has a first vertical portion, extending upwardly about the guide roller 6, and then has a horizontal portion which is directed towards the zone of the printing systems for lateral or essentially horizontal introduction of the paper web 5 into the printing systems, for example between two cylinders, which may be the rubber cylinder and a central counter or impression cylinder of the printing machine 1.

As schematically illustrated in FIG. 1, an operator has access to the plate cylinder 3, and the printing system associated therewith, by positioning himself behind the vertical portion of the paper web 5 and the left side of the printing machine 1; this permits the operator, for example, to change the plate on the plate cylinder 3. Access to the plate or plate cylinder 2, however, is impeded by the horizontal portion of the web 5 which has been deflected by the guide roller 6. To change the plate on plate cylinder 2, then, is cumbersome.

Figure 2:
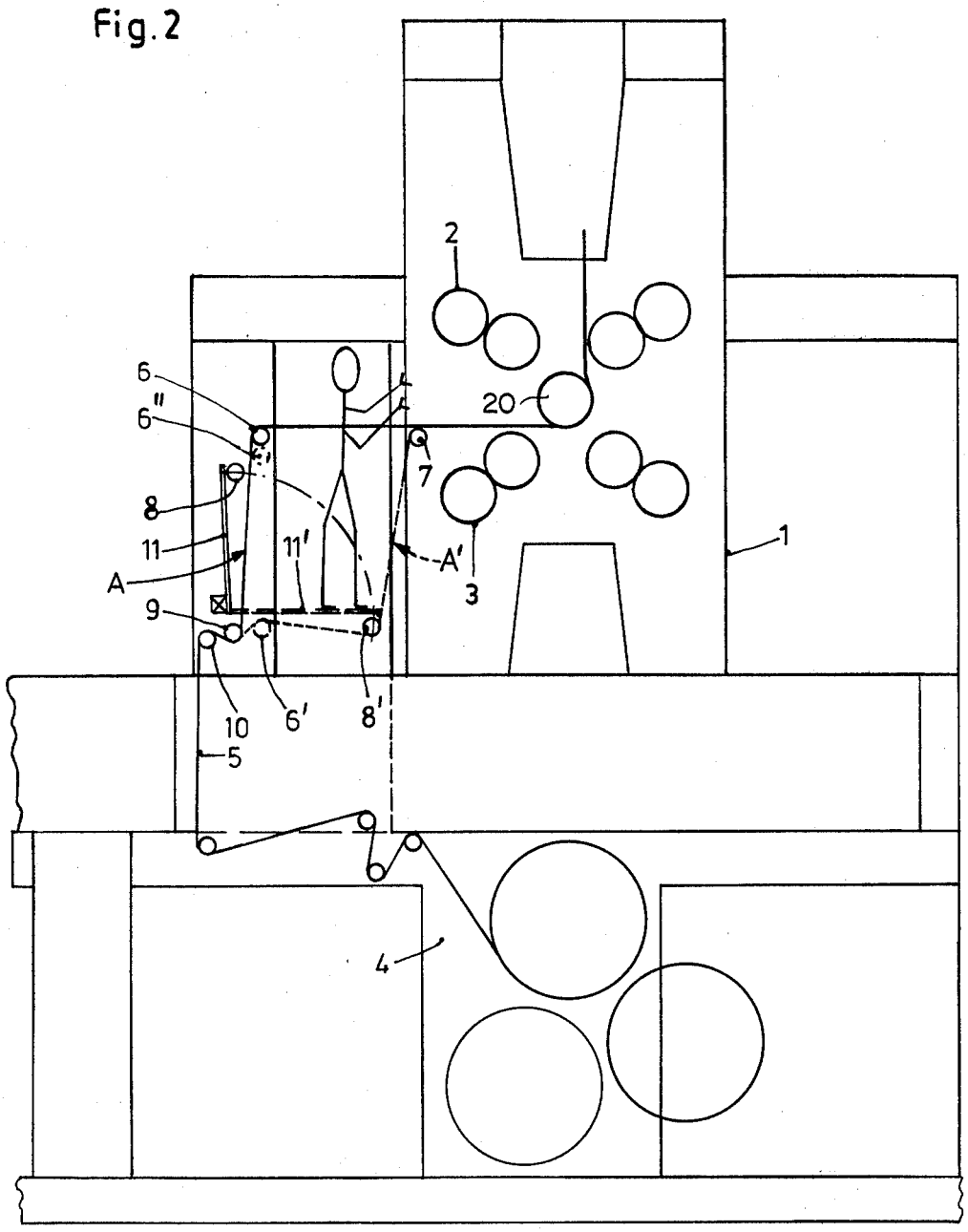
FIG. 2 illustrates a similar printing machine, and modified in accordance with the present invention, to permit, selectively, repositioning of the path of the paper web through the printing machine.
Figure 3:
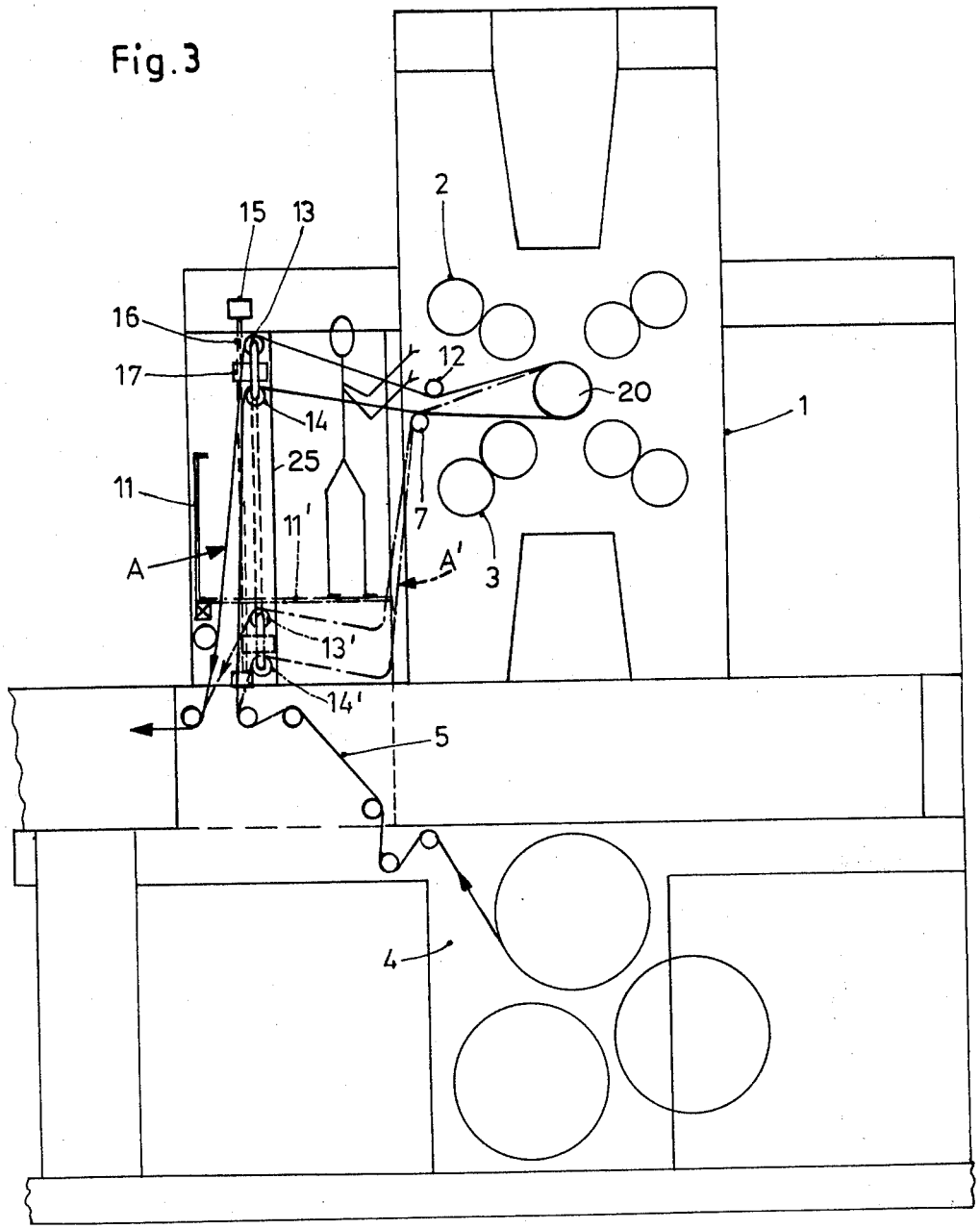
FIG. 3 is a highly schematic view illustrating another example of a paper web path in accordance with the present invention.

In accordance with the present invention—and as illustrated in FIGS. 2 and 3—it is possible to obtain access also to the plate cylinder 2 by changing the path of the paper web 5, selectively, when such access to the upper plate cylinder 2 is desired, permitting change of plates, or maintenance or repair work to the printing system associated with plate cylinder 2.

FIG. 2 illustrates, basically, the same system as that shown in FIG. 1, and incorporating the present invention, which provides for movement of the paper guide roller 6, in a vertically dropping direction, from the full-line position 6 to the broken-line position 6'. In the dropped position 6' of the paper guide roller, the paper web 5 is then guided over a deflection guide roller 8, then in the position 8', and deflected by the guide roller at position 8' so that the vertical portion A of the paper web guide path will be moved from the rear of the operator to the position A', as shown in FIG. 2, and in front of the operator. The horizontal and vertical portions of the guide path are thus, respectively, reversed in relation to the printing station 1 to, selectively, permit access either to the upper or to the lower printing systems of the printing station 1. The paper web 5 is guided over guide or deflection rollers 9, 10 and then, when in the path A', over the dropped guide roller 6', the deflection guide roller 8', and over a further guide roller 7, which is usually already provided in the printing machine. In the position shown in FIG. 2 in broken lines, the paper web is stretched or tensioned so that the machine can print, and the operator can observe the actual printing operation of the machine.

A platform or support surface 11 is provided which, after the guide roller 6 is dropped to the position 6', is flipped downwardly to the position 11'—see FIG. 2—from a vertical position to a horizontal—to permit the operator to stand thereon. The platform 11, when in the position 11', will be positioned above the horizontal portion of the paper web guide path, when in the broken-line position. An operator, standing on the platform 11 in the position 11' can readily carry out any necessary maintenance adjustment or other work, and easily change the plate on the plate cylinder 2 when the machine is stopped. The deflection guide roller 8' may, for example, be supported by lateral extensions on the platform 11 so that, upon swinging platform 11 from the full-line position downwardly to the broken-line position, the paper web will automatically be retensioned and will be positioned beneath the platform. The deflection guide roller 8 can be secured to the platform, for example, by welded brackets or the like, in accordance with any suitable and well known structural arrangement.

Embodiment of FIG. 3: The web 5 is guided into the printing station 1 through an essentially horizontally directed, laterally open printing zone and, after having been printed, is again carried out essentially horizontally, laterally, from the printing station 1. Instead of having a single guide roller 6, two guide rollers 13, 14 are used, each engaging the respective portions of the paper web which are being introduced into the printing station and removed therefrom. When the guide rollers 13, 14 are in the upper position, and the platform 11 is in the full-line position as shown in FIG. 3, an operator standing, for example, on a support or holding strip, or on a gang plank on the printing station 1 has ready access to the lower plate cylinder 3, and all the apparatus, such as cylinders, inking and damping fountains, and the like, associated therewith. Upon dropping of the guide rollers 13, 14 to the broken line positions 13', 14', and pivoting of the platform 11 downwardly to the position 11', and opertor—shown schematically in full line, and standing on the platform 11, has ready access to the upper printing system, as schematically represented by the plate cylinder 2.

The guide rollers 13–14 can be moved from the upper to the lower position by a power or automatically operating positioning system which, in the embodiment shown, includes an electric motor 15 driving a vertical threaded spindle 16 which is coupled to a follower slider 17 to which the rollers 13, 14 are attached. The spindle 16 may have a double spiral, or the motor can be of the reversing-direction type. The guide rollers 13, 14, guided in suitable guide tracks or slots 25 in the frame of the machine and secured to the slider 17, then can be moved from the upper position as shown to the broken-line position 13', 14'. The spindle 16 can be positioned centrally, on one side of the machine, or, preferably, two spindles at both axial ends of the rollers 13, 14 are provided, driven in synchronism.

FIG. 3 illustrates a further feature of the present invention; the deflection guide roller 8 has been omitted so that, when the guide rollers 13, 14 are moved from the upper to the lower, broken-line position, the paper web 5, both in its entering as well as in its leaving path—with respect to the printing station 1—will hang through as schematically shown in the chain-dotted path of the web 5. Omitting the guide roller 8 does not permit printing when the guide rollers 13, 14 are in their lower position, but rotation of the respective cylinders, for example plate cylinders 2, 3, manually, or at low speed, is possible without producing defective printing material. Likewise, only partially dropping guide rollers 6 in the embodiment of FIG. 2 to, for example, the position shown at 6'', permits release of tension from the web 5, and rotation of the respective printing cylinders of the printing systems without, however, resulting in misalignment of the web on the printing cylinders. It is, of course, entirely possible to position one or more rollers corresponding to roller 8 also in the structure of FIG. 3 to provide for tensioning of the paper web section introduced into, as well as removed from, the printing station 1, for example by locating such a deflection guide roller or rollers on the platform 11 for automatic tensioning when the platform 11 is moved into the position 11'.

Various changes and modifications may be made, and features described in connection with one of the embodiments may be used with the other, within the scope of the inventive concept.

I claim:

1. Rotary printing machine having a printing station (1, 2, 3);

two vertically staggered guide rollers (13, 14), one being associated with a section of a paper web (5) being supplied to a printing cylinder (20) of the printing station, and the other being associated with a section of the paper web being removed from the printing station, said guide rollers guiding the paper web in a guide path having a portion extending essentially in vertical direction (A, A'), a portion extending in essentially horizontal direction for guidance of the paper web with respect to the printing cylinder of the printing station, the portion extending in essentially horizontal direction being sufficiently long to space the essentially vertical portion of the path from the printing station by a distance sufficient to render the printing station accessible to an operator;

vertically movable positioning means (15, 16, 17) coupled to the two guide rollers and selectively positioning the two guide rolers with respect to the printing station to change the relative position of the essentially horizontal portion and the essentially vertical portion of the guide path of the web (5) with respect to the printing station;

a pivotable operator platform (11) selectively horizontally positionable above the horizontal portion of the web path when the essentially vertical portion of the web is adjacent the printing cylinder, and the horizontal portion is remote from the printing cylinder, and separated therefrom by the essentialy vertical portion (A'), and pivotable to a vertical position about a pivot axis located remote from the vertical portion of the web when the vertical portion of the web is adjacent the printing station; and guide means (25) guiding movement of the two guide rollers (13, 14) between an upper and a lower position in which, respectively, when the guide rollers are in the upper position, the horizontally extending portion of the web is in essential alignment with the printing cylinder, and thereby spacing the portion extending in vertical direction from the printing cylinder by the horizontally extending portion, and, when the guide rollers are in the lower position, the horizontally extending portion of the web is positioned below the pivot axis of the pivotable operator platform.

2. Printing machine accordiing to claim 1, further including a deflection guide roller (8) introduced in the path of the paper web (5) beween the essentially horizontal portion and the essentially vertical portion when the guide roller means is moved to a lower position in said vertical direction.

3. Printing machine according to claim 2, further including a directing guide roller (7) directing the path of the paper web (5) from one of said guide path portions to the printing cylinder of the printing station.

4. Printing machine according to claim 2, wherein said printing cylinder is an impression cylinder.

5. Printing machine according to claim 1, wherein said operator platform (11) comprises a pivotable support element having its pivot axis adjacent the vertical portion of the paper web path when the guide roller means is in the raised or upper position;

and wherein said deflection guide roller (8) is secured to the platform support at a position remote from the pivoting axis thereof.

6. Printing machine according to claim 1, further including a directing guide roller (7) direcing the path of the paper web (5) from one of said guide path portions to the printing cylinder of the printing station.

7. Printing machine according to claim 6, wherein said printing cylinder is an impression cylinder.

8. Printing machine according to claim 1, wherein said movable guide roller positioning means provide for partial dropping of the guide roller in said vertical direction to release tension on the web (5).

9. Printing machine according to claim 8, wherein said printing cylinder is an impression cylinder.

10. Printing machine according to claim 1, wherein the movable guide roller positioning means comprises a motor (15) and a spindle drive, the guide roller means being coupled to said spindle drive, to move the guide roller means in said vertical direction between a raised position in which said essentially horizontal portion is directed towards the printing cylinder of the printing station, and permits access beneath the horizontal portion to a printing system located beneath the essentially horizontal portion, and a lowered position in which the essentially horizontal portion is positioned beneath said operator platform and permits access by the operator to a printing system above the web;

and to intermediate positions to release tension on the web.

11. Printing machine according to claim 10, wherein said printing cylinder is an impression cylinder.

12. Printing machine according to claim 1, further including a directing guide roller (7) positioned to direct the section of the paper web being removed from the printing cylinder of the printing station in a predetermined guide path.

13. Printing machine according to claim 1, wherein said printing cylinder is an impression cylinder.

* * * * *

UNITED STATES PATENT AND TRADEMARK OFFICE

CERTIFICATE OF CORRECTION

PATENT NO. : 4,393,772

DATED : July 19, 1983

INVENTOR(S) : Rainer BURGER

It is certified that error appears in the above—identified patent and that said Letters Patent is hereby corrected as shown below:

Claim 5, line 1 (col. 6, line 9) change "according to claim 1" to -- according to claim 2 --.

Signed and Sealed this

*Twenty-second* Day of *November 1983*

[SEAL]

*Attest:*

GERALD J. MOSSINGHOFF

*Attesting Officer*

*Commissioner of Patents and Trademarks*